United States Patent [19]

Liebel

[11] Patent Number: 4,865,201

[45] Date of Patent: Sep. 12, 1989

[54] COMBINATION LAMINATED CORRUGATED PAPER CORNER POST

[75] Inventor: Henry L. Liebel, Cincinnati, Ohio

[73] Assignee: Shippers Paper Products Company, Loveland, Ohio

[21] Appl. No.: 286,270

[22] Filed: Dec. 19, 1988

[51] Int. Cl.[4] ..... B65D 81/02

[52] U.S. Cl. ..... 206/586; 206/326; 220/448; 229/DIG. 1

[58] Field of Search ..... 206/586, 453, 326; 229/DIG. 1; 220/448

[56] References Cited

U.S. PATENT DOCUMENTS

| | | | |
|---|---|---|---|
| 2,068,771 | 1/1937 | Sherman | 229/14 |
| 2,160,221 | 5/1939 | Masters et al. . | |
| 2,196,157 | 4/1940 | White . | |
| 2,271,265 | 1/1942 | Kirby . | |
| 2,514,833 | 7/1950 | Bergeron . | |
| 2,556,529 | 6/1951 | Farrell | 206/586 X |
| 3,072,313 | 1/1963 | Svendsen . | |
| 3,133,687 | 5/1964 | Fremion . | |
| 3,337,111 | 8/1967 | Petriekis et al. . | |
| 3,433,354 | 3/1969 | Liebel . | |
| 3,536,245 | 10/1970 | Palmer | 229/14 |
| 3,556,529 | 1/1971 | Noriega | 273/137 |
| 3,708,101 | 1/1973 | McDanield | 229/14 |
| 3,734,389 | 5/1973 | Brown | 229/14 |
| 4,027,817 | 6/1977 | Fremion | 229/14 |
| 4,120,441 | 10/1978 | Hurley | 206/586 |
| 4,260,071 | 4/1981 | Bamburg et al. | 206/586 X |
| 4,292,901 | 10/1981 | Cox | 108/55.1 |
| 4,399,915 | 8/1983 | Sorenson | 206/586 |
| 4,784,270 | 11/1988 | Layer et al. | 206/586 |

FOREIGN PATENT DOCUMENTS 2080767 2/1982 United Kingdom .

*Primary Examiner*—William Price

*Attorney, Agent, or Firm*—Wood, Herron & Evans

[57] ABSTRACT

A corner post including elongated inner and outer rigid right angle laminated paperboard members and a core of corrugated paper adhered to the members with the flutes being perpendicular to long edges of the members.

4 Claims, 2 Drawing Sheets

COMBINATION LAMINATED CORRUGATED PAPER CORNER POST

BACKGROUND OF THE INVENTION

This invention relates to corner posts used in the packaging of articles and, particularly, to corner posts applied, e.g., as vertical corner posts such as for insertion into the corners of a straightsided flexible container adapted for cushioning the straight corners and edges of packaged articles along the full height thereof and also adapted to permit the stacking of the packaged articles on each other without damaging the container or the article contained therein, and horizontal corner posts permitting pick up and movement of packed articles by a squeeze truck without sideways crushing of the articles.

In packaging a number of articles including heavy articles such as refrigerators, television sets, stoves, air conditioners, and washing machines and dryers, it is customary to package them in relatively lightweight containers formed of paperboard or corrugated or to envelop them in a plastic film such as by shrink or stretch wrap techniques. The article is located and cushioned within the container or film by corner posts which typically are one or more pieces of cardboard folded to a 90° angle and inserted along the edges of the article and the corners of the containers or film. Such corner posts are used to provide cushioning to protect the corners of the packed article from damage such as scratching and denting during shipping and handling.

A number of corner posts are known to the art. Representative of such designs are U.S. Pat. Nos. 2,068,771; 2,160,221; 2,196,157; 2,514,833; 3,556,529; 3,133,687; 3,337,111; 3,536,245; 3,072,313; 3,433,354; 3,708,101; 3,734,389; 4,120,441; and G.B. No. 2,080,767. These prior art corner posts, however, all have one or more of the following disadvantages. Although some provide relatively good cushioning, they do not provide a load bearing capacity in the vertical direction which would permit the vertical stacking of loaded containers, or, if they do, they are of substantial bulk and thus require large amounts of materials, are heavy, and take up space. For protectors not providing vertical load bearing capacity, when stacking of such containers is attempted, the weight of the upper container crushes the underlying containers by bending or buckling the walls of the container which bear the stacking load. Others which attempt to provide such vertical load bearing capacity in turn do not always provide sufficient cushioning and/or are relatively complex in design and expensive to manufacture. Since the packaging materials do not add value to the product itself, the costs of such materials are an important consideration to the manufacturer who uses such posts in shipping finished goods. Finally, some designs are subject to crushing by lateral forces supplied to the container and by shifting movement of the article within the container detracting from the cushioning protection for the edge and corners of the article.

In my U. S. Pat. No. 4,771,893, I provide an integral, elongated corner post for cushioning and protecting the edges of a packaged article which provides excellent vertical load bearing or stacking strength and excellent horizontal load bearing strength as the case may be, good cushioning, good impact resistance, substantial thickness for spacing the outer surface of the packaged article from the side walls of the container or film but with a minimum of material, and which is lightweight, clean with no rough edges, and simple in design and relatively economical to produce.

In one preferred form of that invention, the corner post includes a core formed of single-face corrugated having a smooth facing sheet and a corrugated or fluted sheet glued thereto. A second sheet of single-face corrugated is wrapped about this core at least one time with the flutes thereof being adhered to the surfaces of the underlying core and lying perpendicular to the flutes of the core. This wrapping includes the vertical edges of the core giving the corner protector desired smooth, rounded edges. Moreover, the corner protector's outer surface comprises the plain paper face of the second singleface corrugated giving the product a desired continuous, smooth outer surface. The core is scored to permit its bending to a 90° angle; and, when bent, the apex of the angle is smooth and rounded. The perpendicularity of the three layers of flutes and the rounded edges and apex provided the corner post with excellent load bearing strength and minimum warp.

Also known to the art is a corner post comprised of multiple layers of elongated corrugated paper which are bent into right angles laid one upon the other and glued together with the flutes of the corrugated paper extending generally perpendicular to the long direction of the legs. This corner post has, however, relatively poor columnar and beam strength.

SUMMARY OF THE INVENTION

The present invention provides a combination laminated corrugated paper corner post which has improved shock resistance, increased columnar and beam strength, and a better ratio of strength to unit weight than the corner posts described above or otherwise available to the art. The corner post of the present invention includes inner and outer members each formed of multiple layers of paperboard laminated together and formed into elongated right angles to provide like pairs of elongated right angle legs joined at a smooth rounded apex and overlying one another, and a core of corrugated paper disposed between the inner and outer members and having a series of axially aligned flutes generally perpendicular to the long direction of said legs, the core being glued to the inner and outer members. The corrugated core may be formed of either single or double-face corrugated or a combination thereof. Moreover, the core can be composed of multiple layers of either of single or double face corrugated paper or both to increase the thickness thereof.

The combination of a corrugated core and inner and outer laminated and formed non-corrugated paperboard right angles has been found to result in an improved corner post having increased shock resistance, increased columnar and beam strength, and an improved strength to unit weight ratio. The resulting core thus provides improved strength permitting stacking of packaged articles on each other without buckling of the corner post which would otherwise result in damaging of the container or the articles contained therein but which combines such increased stacking strength with a relatively lighter unit weight post.

DETAILED DESCRIPTION OF THE INVENTION

Figure 1:
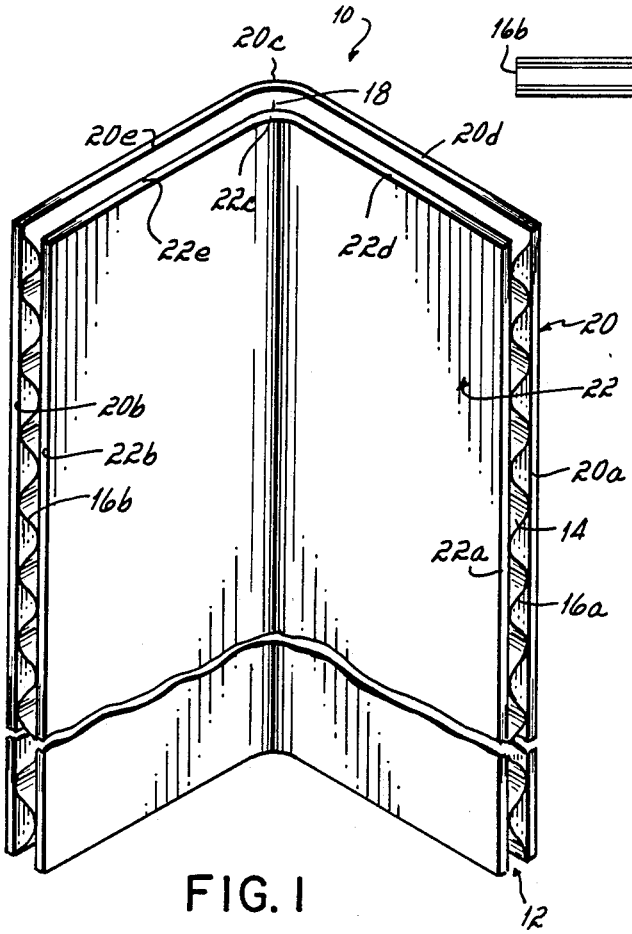
FIG. 1 is a perspective view of one embodiment of the corner post of the present invention.

Referring first to FIG. 1, the corner post 10 of the present invention includes a core 12 of corrugated paper. The core may be of any desired thickness, however, it has been found that a thickness of about ⅛" to about ¼" thick or somewhat greater thickness is suitable. The core 12 includes at least a fluted paper sheet 14 and includes a pair of lengthwise edges 16*a*, 16*b*. The flutes of the core lie at a 90° angle to the lengthwise edges 16*a*, 16*b*. The fluted sheet 14 may be scored along a line 18 to permit bending of the core into a right angle.

The core 12 may be formed of a single fluted sheet, of single-face corrugated including a smooth paper facing sheet to which is glued a corrugated or fluted sheet, of double-face corrugated wherein the fluted sheet is glued to a pair of outer paper facing sheets, or, as disclosed hereinafter, of any combination thereof.

The core 12 is sandwiched between outer and inner rigid paperboard right angles 20, 22. Each rigid right angle 20, 22 includes a pair of lengthwise edges 20*a*, 20*b* and 22*a*, 22*b*, and a smooth rounded apex 20*c* and 22*c*, respectively.

Each of the rigid right angles is formed generally of an extended length by bringing together from multiple rolls sheets of paperboard and laminating them together with a suitable adhesive such as a sodium silicate slurry. The multiple plies of laminated paperboard that are glued together are then formed into rigid right angles of relatively high strength. That is, the multiple plies of laminated paperboard are formed into right angles while the individual plies are sufficiently slidable one with another to permit their sliding relative to one another for forming into a right angle. Once the adhesive is set, the final article is of relatively high strength. It has been found that such a construction provides an extended, rigid right angle which has a relatively high columnar and beam strength and resistance to deflection. The thickness of the resulting angles is a function of the number and thickness of the paperboard plies used to form the angle. The thickness may vary depending on the particular application but generally thicknesses in the range of ⅛" to ¼" have been found suitable.

Each of the formed, rigid right angles has a pair of like legs 20*d*, 20*e* and 22*d*, 22*e*. In the finished construction, leg 20*d* substantially overlies leg 22*d* and leg 20*e* substantially overlies leg 22*e* with the corrugated paper core 12 sandwiched therebetween. A suitable adhesive is used for joining the corrugated core to the outer and inner angles 20, 22.

Figure 2:
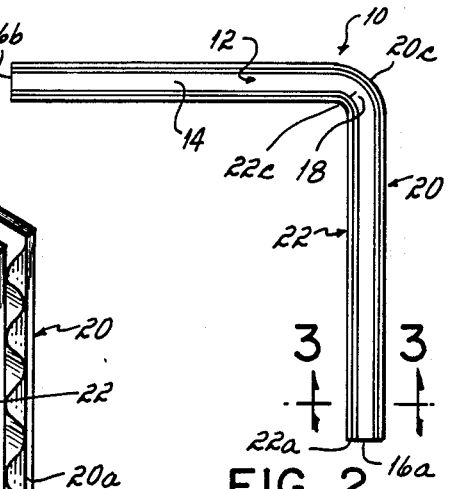
FIG. 2 is a top view of the corner post shown in FIG. 1.
Figure 3:
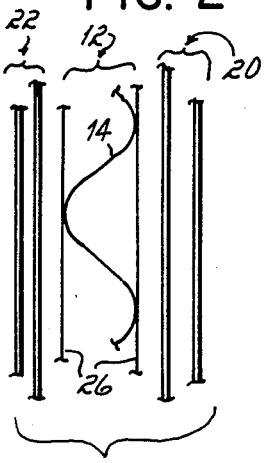
FIG. 3 is a disassembled view taken along line 3—3 of FIG. 2.

Referring in addition to FIGS. 2 and 3, the core 12 may desirably be formed of double-face corrugated having a corrugated or fluted sheet 14 and a pair of smooth paper facing sheets 26 adhered thereto. The facing sheets 26 are then in turn adhered to the inner and outer rigid right angles 22, 20 by a suitable adhesive such as sodium silicate.

Figure 4:
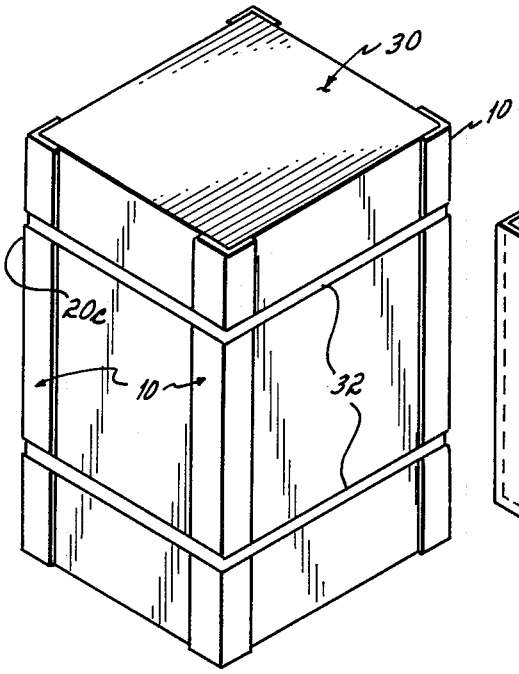
FIG. 4 is a perspective view showing one application of the corner post of the present invention.
Figure 5:
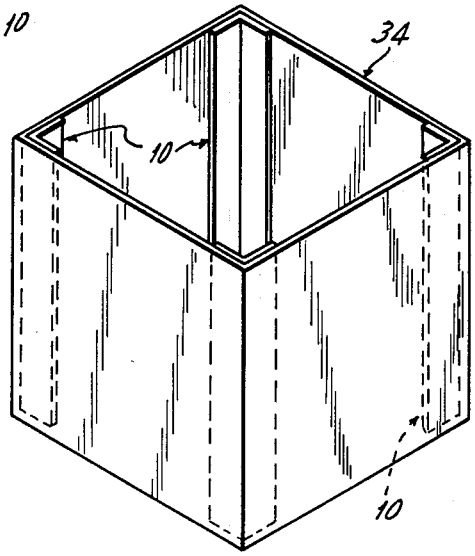
FIGS. 5 and 6 are perspectives view showing other applications of the corner post of the present invention.
Figure 6:
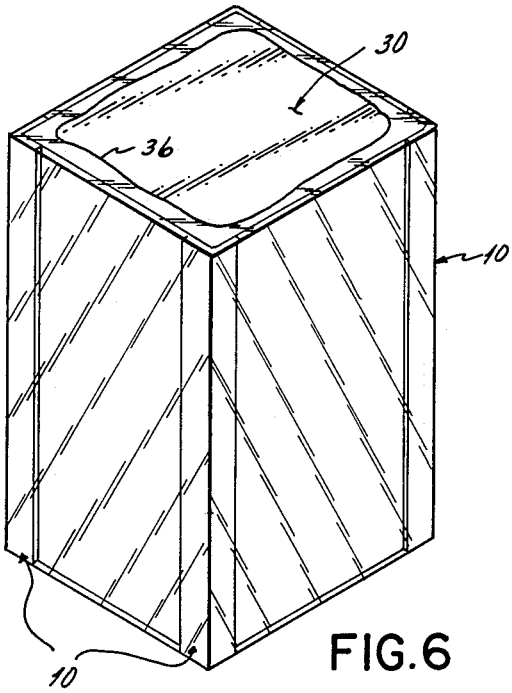

Referring now to FIGS. 4, 5 and 6, three environments are illustrated showing the use of the corner post of the present invention. In FIG. 4, the article 30 is shipped with corner posts 10 at its four vertical edges being retained thereby by upper and lower bands or straps 32 surrounding the article 30. The rounded apex 20c of the corner post 10 provides for tightening of the straps 32 including their biting into the surface thereof without damaging the article. The core 12 provides good cushioning to the edges of the article and the rigid right angles 20, 22 provide the corner post with excellent columnar and beam strength.

In FIG. 5, there is shown an alternative environment where the article is placed in a cardboard or a paperboard container 34 having thin walls. The corner posts 10 occupy the four corners of the container 34 again providing all of the advantages recited above including good stacking strength, good cushioning, good impact resistance and providing substantial offset between the surface of the article and the side walls of the container.

In FIG. 6, the corner posts 10 are placed along the edges of the article 30 after which the article and corner posts 10 are enveloped in a plastic film 36 such as by known stretch wrap and shrink wrap techniques. Again, the corner posts 10 provide the desired edge protection to the article.

Figure 7:
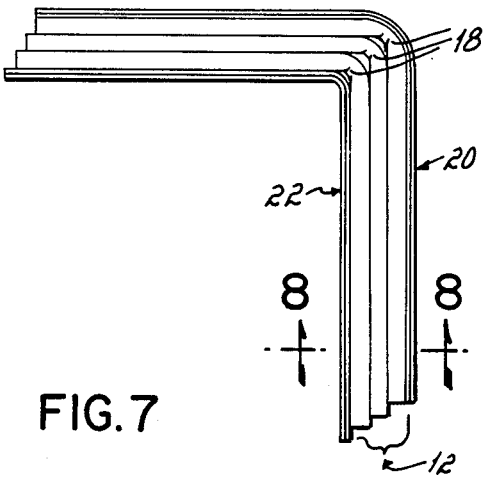
FIG. 7 is a top view of a second form of corner post.
Figure 8:
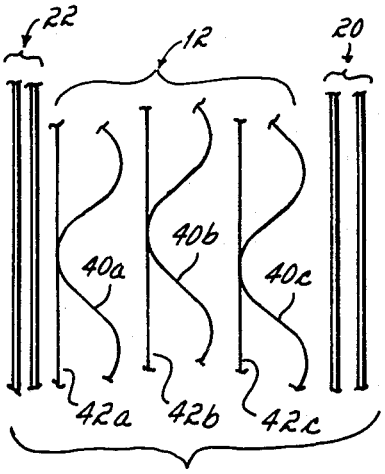
FIG. 8 is a disassembled view taken along line 8—8 of FIG. 7.

Referring now to FIGS. 7 and 8, in an alternative embodiment, the core 12 is formed of multiple sheets of single-face corrugated paper including fluted sheets 40*a, b, c* and single-facing sheets 42*a, b, c* adhered thereto. Facing sheet 42*a* is adhered to one of the rigid right angles 22 while the fluted sheet 40*c* is adhered to the other rigid right angle 20. All of the flutes run in the same direction, i.e., perpendicular to the long edges 20*a*, 22*a* and 20*b*, 22*b* of the rigid right angles 20, 22. The single-face sheets may likewise be scored at 18 along their apices to permit their bending into a right angle configuration. The use of multiple layers of corrugated paper provides the core 12 with an increased thickness as shown in FIG. 7.

As may be seen, the corner post 10 is made of relatively inexpensive materials, i.e., sheets of corrugated paper and a pair of like rigid preformed paperboard angles, is relatively simple in design, and is economical to produce. However, the combination of elements results in a combination of highly desirable properties including increased columnar and beam strength, increased strength to unit weight ratio, and shock resistance.

Thus having described the invention, what is claimed is:

1. An integral, elongated corner post for cushioning and protecting an edge of an article comprising, in combination, inner and outer members each formed of multiple layers of paperboard laminated together and formed into elongated rigid right angles to provide like pairs of elongated right angle legs joined at a smooth, rounded apex;

said like pairs of legs of said inner and outer members being in substantially overlying relationship, a core of corrugated paper disposed between said inner and outer members and having a series of aligned flutes generally perpendicular to the long direction of said legs, and means for adhering said corrugated paper to said inner and outer members.

2. The corner post of claim 1 wherein said core comprises at least a sheet of single-face corrugated paper including a facing sheet and a corrugated sheet having said series of aligned flutes and wherein said means for adhering includes means for adhering said facing sheet to one of said members and said flutes of said corrugated sheet to the other of said members.

3. The corner post of claim 1 wherein said core comprises at least a sheet of double-face corrugated paper including spaced facing sheets on either side of and adhered to a corrugated sheet and wherein said means for adhering includes means for adhering said facing sheets to said inner and outer members.

4. The corner post of claim 1 wherein said core comprises multiple sheets of single-face corrugated paper each including a facing sheet and a corrugated sheet having said series of aligned flutes and wherein said means for adhering include means for adhering the facing sheet of one of said multiple sheets to one of said members and the corrugated sheet of another of said multiple sheets to the other of said members.

* * * * *